US010392883B2

(12) United States Patent
Thornburrow et al.

(10) Patent No.: US 10,392,883 B2
(45) Date of Patent: Aug. 27, 2019

(54) CASING HANGER LOCKDOWN TOOLS

(71) Applicant: Cameron International Corporation, Houston, TX (US)

(72) Inventors: Edward T. Thornburrow, Drighlington (GB); Edward J. Thornton, Bickerton (GB)

(73) Assignee: Cameron International Corporation, Houston, TX (US)

( * ) Notice: Subject to any disclaimer, the term of this patent is extended or adjusted under 35 U.S.C. 154(b) by 253 days.

(21) Appl. No.: 15/300,935

(22) PCT Filed: Mar. 31, 2015

(86) PCT No.: PCT/US2015/023471
§ 371 (c)(1),
(2) Date: Sep. 30, 2016

(87) PCT Pub. No.: WO2015/153541
PCT Pub. Date: Oct. 8, 2015

(65) Prior Publication Data

US 2017/0016294 A1 Jan. 19, 2017

Related U.S. Application Data

(63) Continuation-in-part of application No. 14/244,583, filed on Apr. 3, 2014, now Pat. No. 9,598,928.

(60) Provisional application No. 62/134,459, filed on Mar. 17, 2015.

(51) Int. Cl.

| | |
|---|---|
| ***E21B 33/04*** | (2006.01) |
| ***E21B 23/01*** | (2006.01) |
| ***E21B 33/14*** | (2006.01) |

(52) U.S. Cl.
CPC ..... *E21B 23/01* (2013.01); *E21B 33/04* (2013.01); *E21B 33/0415* (2013.01); *E21B 33/14* (2013.01)

(58) Field of Classification Search
CPC ..... E21B 23/02; E21B 33/04
See application file for complete search history.

(56) References Cited

U.S. PATENT DOCUMENTS

| | | | | |
|---|---|---|---|---|
| 3,287,030 A | | 11/1966 | Crain et al. | |
| 3,341,227 A | | 9/1967 | Pierce, Jr. | |
| 3,492,026 A | * | 1/1970 | Ahlstone | E21B 33/043 166/348 |
| 3,809,158 A | * | 5/1974 | Bonds | E21B 33/043 166/285 |
| 3,871,449 A | | 3/1975 | Ahlstone | |
| 3,972,546 A | | 8/1976 | Putch | |
| 4,171,018 A | * | 10/1979 | Walker | E21B 43/10 166/196 |
| 4,353,420 A | | 10/1982 | Miller | |

(Continued)

*Primary Examiner* — Shane Bomar
*Assistant Examiner* — Steven A MacDonald
(74) *Attorney, Agent, or Firm* — Eubanks PLLC

(57) ABSTRACT

Various tools for locking components in place within a wellhead housing are provided. In one embodiment, a system includes a lockdown tool (32) having an inner body (40), an outer body (42) coupled to the inner body, and a locking mechanism (44) carried by the inner body. The locking mechanism can be selectively engaged by moving the outer body with respect to the inner body to secure the lockdown tool to the wellhead housing (60). Additional systems, devices, and methods are also disclosed.

20 Claims, 11 Drawing Sheets

(56) References Cited

U.S. PATENT DOCUMENTS

| | | | | | |
|---|---|---|---|---|---|
| 4,407,530 | A | * | 10/1983 | Fowler | E21B 33/04 285/123.12 |
| 4,416,472 | A | | 11/1983 | Fowler et al. | |
| 4,488,740 | A | | 12/1984 | Baugh et al. | |
| 4,561,499 | A | * | 12/1985 | Berner, Jr. | E21B 33/043 166/319 |
| 4,674,576 | A | * | 6/1987 | Goris | E21B 33/043 166/125 |
| 4,836,288 | A | | 6/1989 | Wester | |
| 4,951,988 | A | | 8/1990 | Nobileau | |
| 6,328,108 | B1 | * | 12/2001 | Vanderford | E21B 17/085 166/348 |
| 7,219,738 | B2 | | 5/2007 | Reimert | |
| 2011/0011598 | A1 | | 1/2011 | Nguyen et al. | |
| 2011/0226490 | A1 | | 9/2011 | Nguyen | |
| 2012/0024540 | A1 | | 2/2012 | Harsono et al. | |
| 2012/0305269 | A1 | | 12/2012 | Bories et al. | |
| 2015/0285018 | A1 | | 10/2015 | Thornburrow et al. | |

* cited by examiner 146
164
150
178
182
182
184
186
182
182
170
168
174
172
162
190
148
60
156
158

146
164
150
192
194
178
182
182
184
182
182
170
168
174
172
190
162
148
60
156
158

CASING HANGER LOCKDOWN TOOLS

BACKGROUND

This section is intended to introduce the reader to various aspects of art that may be related to various aspects of the presently described embodiments. This discussion is believed to be helpful in providing the reader with background information to facilitate a better understanding of the various aspects of the present embodiments. Accordingly, it should be understood that these statements are to be read in this light, and not as admissions of prior art.

In order to meet consumer and industrial demand for natural resources, companies often invest significant amounts of time and money in finding and extracting oil, natural gas, and other subterranean resources from the earth. Particularly, once a desired subterranean resource such as oil or natural gas is discovered, drilling and production systems are often employed to access and extract the resource. These systems may be located onshore or offshore depending on the location of a desired resource. Further, such systems generally include a wellhead assembly mounted on a well through which the resource is accessed or extracted. These wellhead assemblies may include a wide variety of components, such as various casings, valves, hangers, pumps, fluid conduits, and the like, that facilitate drilling or production operations.

As will be appreciated, various tubular strings can be run into wells through wellhead assemblies. For instance, wells are often lined with casing that generally serves to stabilize the well and to isolate fluids within the wellbore from certain formations penetrated by the well (e.g., to prevent contamination of freshwater reservoirs). Such casing is frequently hung in a well from a hanger in the wellhead assembly and cemented into place within the well. During a cement job, cement can be pumped down a casing string in a well, out the bottom of the casing string, and then up the annular space surrounding the casing string. The cement is then allowed to set in the annular space.

SUMMARY

Certain aspects of some embodiments disclosed herein are set forth below. It should be understood that these aspects are presented merely to provide the reader with a brief summary of certain forms the invention might take and that these aspects are not intended to limit the scope of the invention. Indeed, the invention may encompass a variety of aspects that may not be set forth below.

Embodiments of the present disclosure generally relate to tools for selectively locking down hangers within wellheads. In some instances, a lockdown tool can also function as a running tool and a cementing tool. That is, the tool can be used to run the wellhead hanger (e.g., a casing hanger) into a wellhead, to secure the wellhead hanger and restrain its movement within the wellhead by locking the tool in place with a locking mechanism, and to then facilitate cementing of a tubular string (e.g., a casing string) within the well. In certain embodiments, the lockdown tool includes a collapsible retaining ring that can be released to engage a wellhead housing and lock the tool in place. The retaining ring can also be collapsed to unlock the tool and allow it to be removed from the wellhead housing. In one embodiment, an outer body of the lockdown tool can be rotated in one direction with respect to an inner body of the tool to release the retaining ring and lock the tool in place. The outer body can later be rotated in the opposite direction to collapse the retaining ring, unlocking the tool from the wellhead housing. Further rotation of the outer body in the opposite direction can also cause the inner body of the tool to rotate and unthread from the casing hanger, allowing the tool to then be removed from the wellhead housing.

Various refinements of the features noted above may exist in relation to various aspects of the present embodiments. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. Again, the brief summary presented above is intended only to familiarize the reader with certain aspects and contexts of some embodiments without limitation to the claimed subject matter.

BRIEF DESCRIPTION OF THE DRAWINGS

These and other features, aspects, and advantages of certain embodiments will become better understood when the following detailed description is read with reference to the accompanying drawings in which like characters represent like parts throughout the drawings, wherein.

DETAILED DESCRIPTION OF SPECIFIC EMBODIMENTS

Specific embodiments of the present disclosure are described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments, the articles "a," "an," "the," and "said" are intended to mean that there are one or more of the elements. The terms "comprising," "including," and "having" are intended to be inclusive and mean that there may be additional elements other than the listed elements. Moreover, any use of "top," "bottom," "above," "below," other directional terms, and variations of these terms is made for convenience, but does not require any particular orientation of the components.

Figure 1:
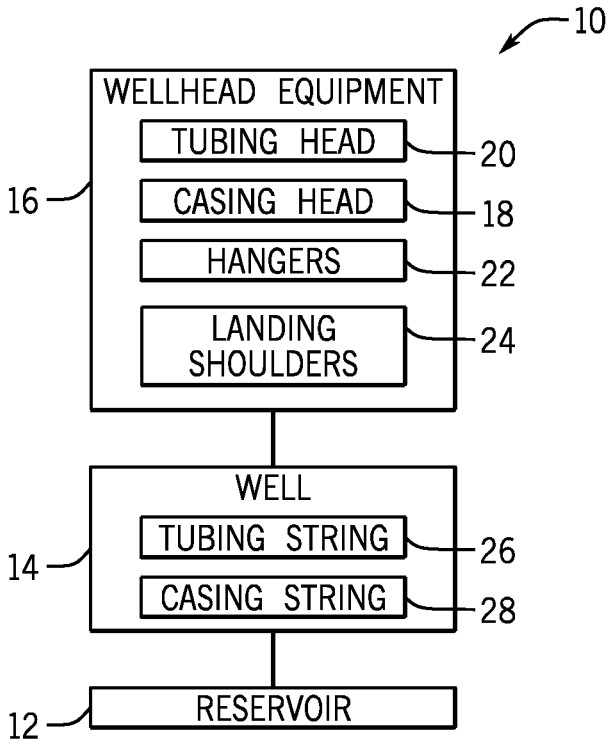
FIG. 1 generally depicts various components, including one or more tubular strings and associated hangers, that can be installed at a well in accordance with one embodiment of the present disclosure.

Turning now to the present figures, a system 10 is illustrated in FIG. 1 in accordance with one embodiment. Notably, the system 10 is a production system that facilitates extraction of a resource, such as oil, from a reservoir 12 through a well 14. Wellhead equipment 16 is installed on the well 14. As depicted, the wellhead equipment 16 includes at least one casing head 18 and tubing head 20, as well as wellhead hangers 22. But the components of the wellhead equipment 16 can differ between applications, and could include a variety of casing heads, tubing heads, spools, hangers, sealing assemblies, stuffing boxes, pumping tees, and pressure gauges, to name only a few possibilities.

The wellhead hangers 22 can be positioned on landing shoulders 24 within hollow wellhead bodies (e.g., within the tubing and casing heads). These landing shoulders 24 can be integral parts of tubing and casing heads or can be provided by other components, such as sealing assemblies (e.g., packoffs) or landing rings disposed in the tubing and casing heads. Each of the hangers 22 can be connected to a tubular string, such as a tubing string 26 or a casing string 28, to suspend the string within the well 14. The well 14 can include a single casing string 28 or include multiple casing strings 28 of different diameters. Any suitable devices or machines may be used to run tubular strings into wells through wellheads and install hangers attached to the tubular strings in the wellheads. For example, a top drive can be used to run a casing string into a well and a casing hanger into a wellhead.

Casing strings 28 are often cemented in place within the well. In some instances, cement is pumped down a casing string 28 and into an annular space around the casing string 28. A plug can then be pumped down the casing string 28 with a displacement fluid (e.g., drilling mud) to generally push additional cement in the casing string out the bottom and into the annular space. As the cement fills the annular space, it displaces drilling mud present in the annular space before cementing began. This causes the displaced drilling mud to flow up the well to the wellhead. Cement hydration during setting of the cement generates heat, which in some instances could cause the casing string to move upward in the well, lifting an attached hanger 22 off its landing shoulder 24 within the wellhead assembly. This displacement can complicate completion of the well 14, such as by interfering with the installation of a seal assembly or other components above the raised casing hanger. And pushing the hanger and the casing string back down could damage cement that has begun to set.

Various embodiments of the present disclosure relate to lockdown tools for locking casing hangers in place within wellheads to prevent unwanted lifting of the casing hangers off their landing shoulders, such as during cementing of casing strings connected to the hangers. Some lockdown tools can also serve as running tools and cementing tools, allowing a single tool to be used to run a casing hanger into a wellhead housing, to lock the casing hanger in place within the wellhead housing (e.g., by locking the tool in place above the wellhead housing), and to allow fluids displaced during cementing to flow up the well through flow-by passages provided in the tool. Moreover, using a single tool for running, locking, and cementing (with one trip into the well) can save time and expense compared to inserting and pulling multiple, different tools into the well for performing these functions. While certain embodiments of lockdown tools are described below in connection with locking down a casing hanger, it will be appreciated that lockdown tools could also be used to secure other components within a wellhead housing.

Figure 2:
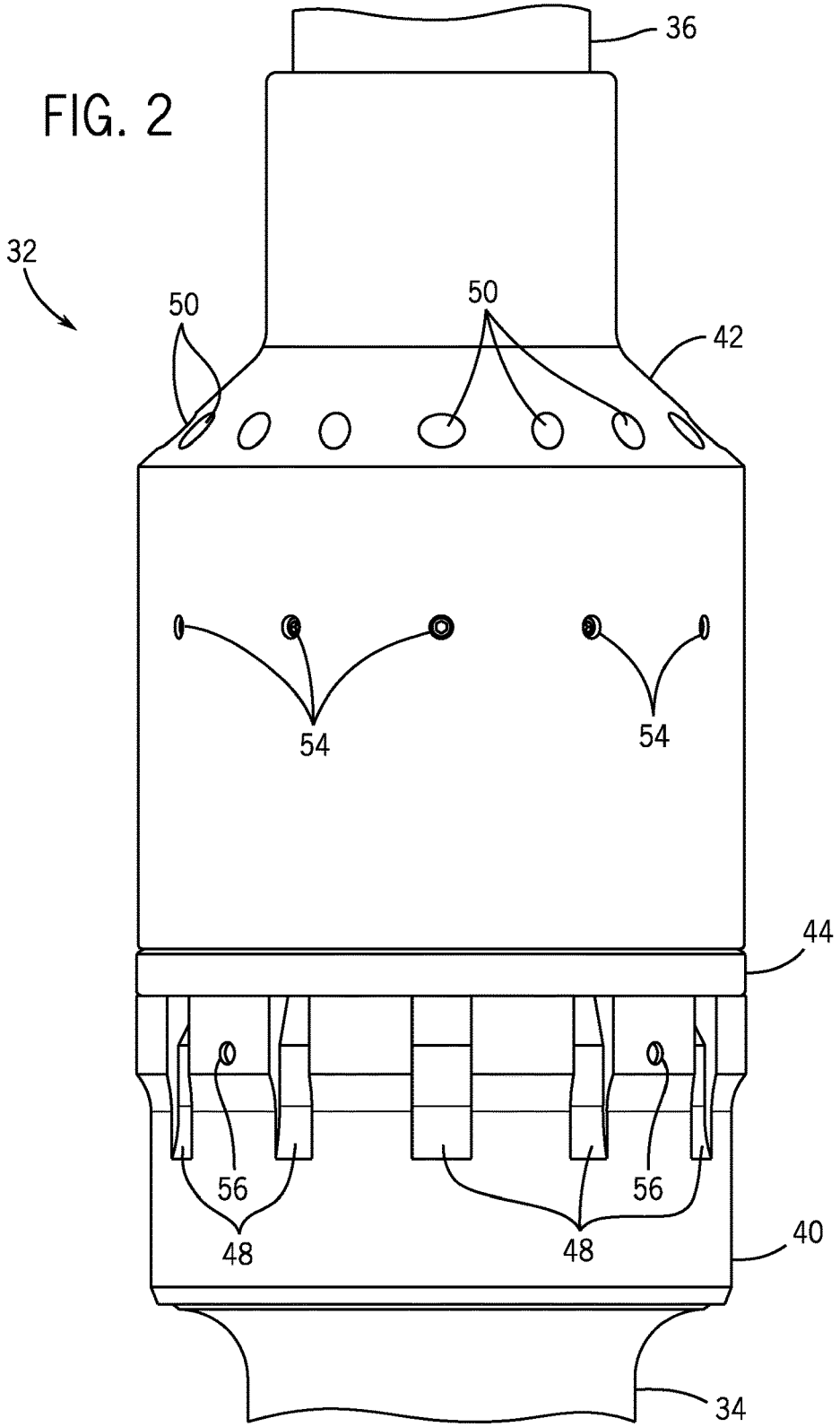
FIG. 2 is an elevational view of a tool for installing a casing hanger in a wellhead housing and locking the casing hanger in place within the wellhead housing in accordance with one embodiment.

With this in mind, one example of a lockdown tool 32 for locking a casing hanger 34 in place within a wellhead housing is depicted in FIG. 2. In the depicted embodiment, the lockdown tool 32 also serves as a running tool and cementing tool, as described in greater detail below. The lockdown tool 32 is coupled at its lower end to the casing hanger 34 and at its upper end to a landing string 36, such as a pup joint. The landing string 36 can be connected to a top drive or any other suitable machine for lowering and raising the lockdown tool 32, the casing hanger 34, and an attached casing string with respect to the well 14 and wellhead equipment 16.

The lockdown tool 32 includes an inner body 40 coupled to an outer body 42. In the embodiment depicted in FIG. 2, a locking mechanism is provided as an outwardly biased, collapsible retaining ring 44 (e.g., a C-ring) carried by the inner body 40. Once the casing hanger 34 is landed on its landing shoulder 24 in a wellhead housing, the retaining ring 44 can be selectively engaged by moving (e.g., rotating) the outer body 42 with respect to the inner body 40 to allow the retaining ring 44 to expand and secure the lockdown tool to the wellhead housing. This serves to also lock the casing hanger 34 in place and inhibits axial movement of the casing hanger 34 off its landing shoulder 24 within the wellhead housing. While certain embodiments are described herein as having locking mechanisms in the form of retaining rings, any other suitable locking mechanisms could be used to lock the tool 32 and the casing hanger 34 in place within a wellhead housing. For instance, in some embodiments the locking mechanisms could instead be provided as pins or lockscrews.

Additional features of the lockdown tool 32 are also visible in FIG. 2 on the exterior of the tool. For example, the lockdown tool 32 includes various flow-by or flow-through passages to facilitate cementing of a casing string attached to the casing hanger 34 while the casing hanger 34 is locked in place by the tool 32. More specifically, the inner body 40 includes flow slots 48 in its exterior surface and the outer body 42 includes flow ports 50. Cement can be pumped down through central bores of the landing string 36, the outer body 42, the inner body 40, the casing hanger 34, and an attached casing string. The slots 48 and ports 50 are separate from the central bores of the inner and outer tool bodies 40 and 42, allowing drilling mud displaced by the cement to flow up the well and through the lockdown tool 32 via the slots 48 and ports 50 even while cement or other fluids are pumped down through the central bores. The lockdown tool 32 also includes holes 54 and 56. In at least some embodiments, and as described in greater detail below, the holes 54 include screws for engaging an internal stop ring and the holes 56 include pins for engaging the casing hanger 34.

Figure 3:
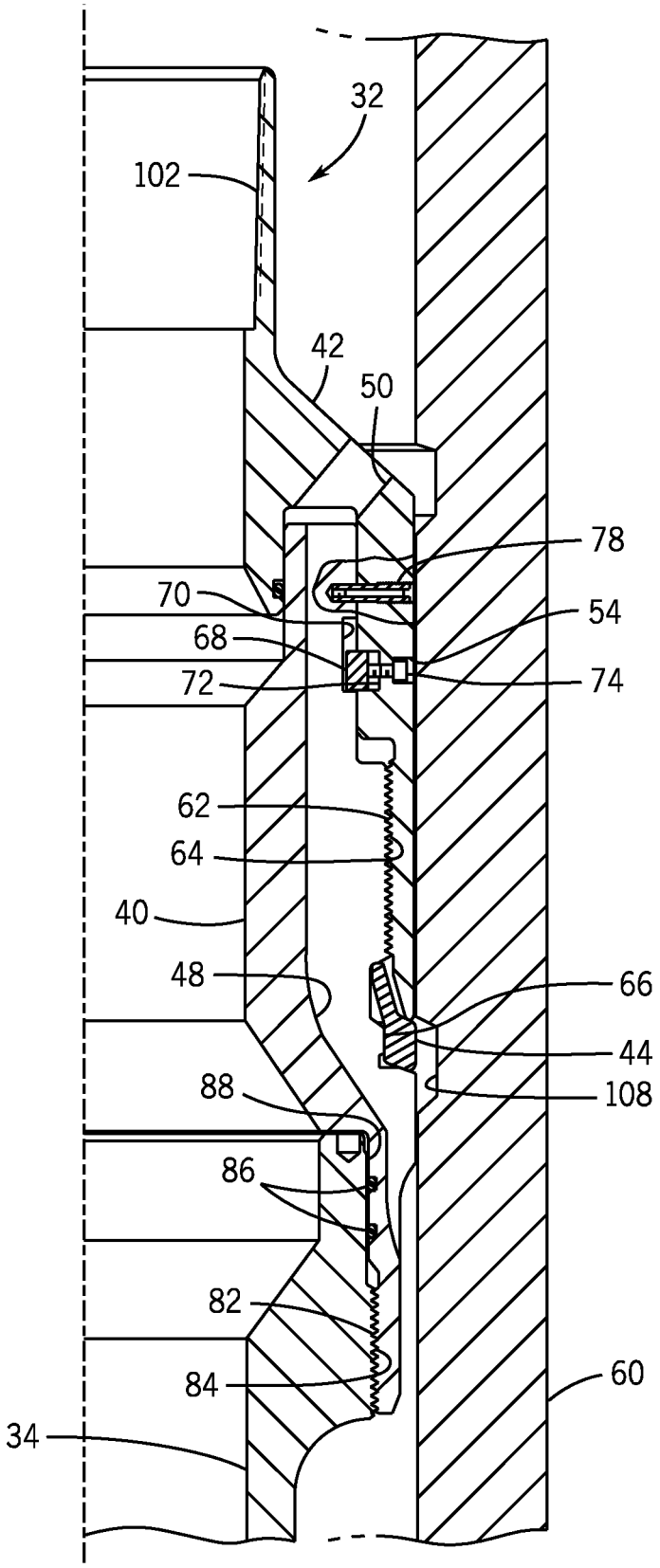
FIG. 3 is a section view of the tool of FIG. 2 positioned within a wellhead housing and depicts a retaining ring in an unlocked position in accordance with one embodiment.

A section view of the lockdown tool 32 and the casing hanger 34 within a wellhead housing 60 is provided in FIG. 3. The wellhead housing 60 can be a casing head 18 or some other component. As shown here, the inner body 40 and the outer body 42 are threaded to one another via mating threaded surfaces 62 and 64, and the outer body 42 is threaded down onto the inner body 40 to restrain the retaining ring 44 within a circumferential groove 66 of the inner body 40. A stop ring 68 is positioned within an outer groove 70 of the inner body 40 and an inner groove 72 of the outer body 42. The stop ring 68 limits the extent to which the outer body 42 can move along the inner body 40 when rotating the outer body 42 along the threads of the surfaces 62 and 64.

In at least some embodiments, including that shown in FIG. 3, the stop ring 68 (e.g., a C-ring) is outwardly biased and pushed into the outer groove 70 of the inner body 40 by screws 74 threaded into the holes 54. During assembly of the lockdown tool 32 before running the casing hanger 34 into the wellhead housing 60, the outwardly biased stop ring 68 is positioned entirely within the inner groove 72 of the outer body 42, allowing the outer body 42 to be threaded onto the inner body 40 and to collapse the retaining ring 44 into the groove 66. The screws 74 can then be used to push the stop ring 68 partially into the outer groove 70. In this position, the stop ring 68 can travel back and forth within the outer groove 70 when the outer body 42 is rotated to translate along the inner body 40. A shear screw 78 can also be installed through the outer body 42 and into the inner body 40 at a location that does not have a flow slot 48 (and is consequently depicted in the present figures within a cut-away area). The shear screw 78 facilitates running of the lockdown tool 32 and the casing hanger 34 into the wellhead housing 60 by preventing inadvertent rotation of the outer body 42 with respect to the inner body 40 and premature release of the retaining ring 44 from the groove 66.

Figure 4:
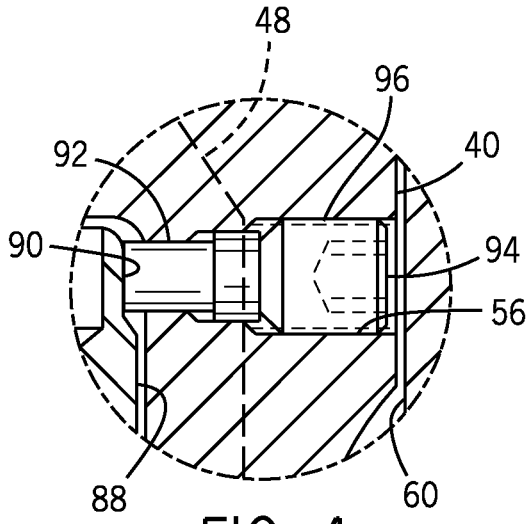
FIG. 4 is a detail view depicting a hold pin and set screw disposed in a hole of the tool of FIG. 2 to engage a neck of the casing hanger in accordance with one embodiment.

The inner body 40 and the casing hanger 34 are also threaded to one another with mating threaded surfaces 82 and 84 in FIG. 3. These two components can be threaded together before running the tool 32 and the casing hanger 34 into the wellhead housing 60. Seals 86 engage seal neck 88 of the casing hanger 34 to inhibit leakage. In at least some embodiments, holding pins are used to prevent inadvertent rotation of the inner body 40 with respect to the casing hanger 34. For example, as shown in FIG. 4, the seal neck 88 includes a recessed portion 90 that is engaged by a holding pin 92 positioned within a hole 56. A screw 94 is inserted into the hole 56 and shares a threaded interface 96 with the inner body 40. The screw 94 can be threaded into the hole 56 to push the holding pin 92 into engagement with the recessed portion 90 of the seal neck 88. While only one arrangement of a pin 92 and a screw 94 in a hole 56 is depicted in FIG. 4, it is noted that such pins 92 and screws 94 could be provided in multiple holes 56 about the inner body 40 for resisting rotation of the inner body 40 with respect to the casing hanger 34. The screws 94 could be tightened to a specified torque to force the pins 92 against the seal neck 88.

Figure 5:
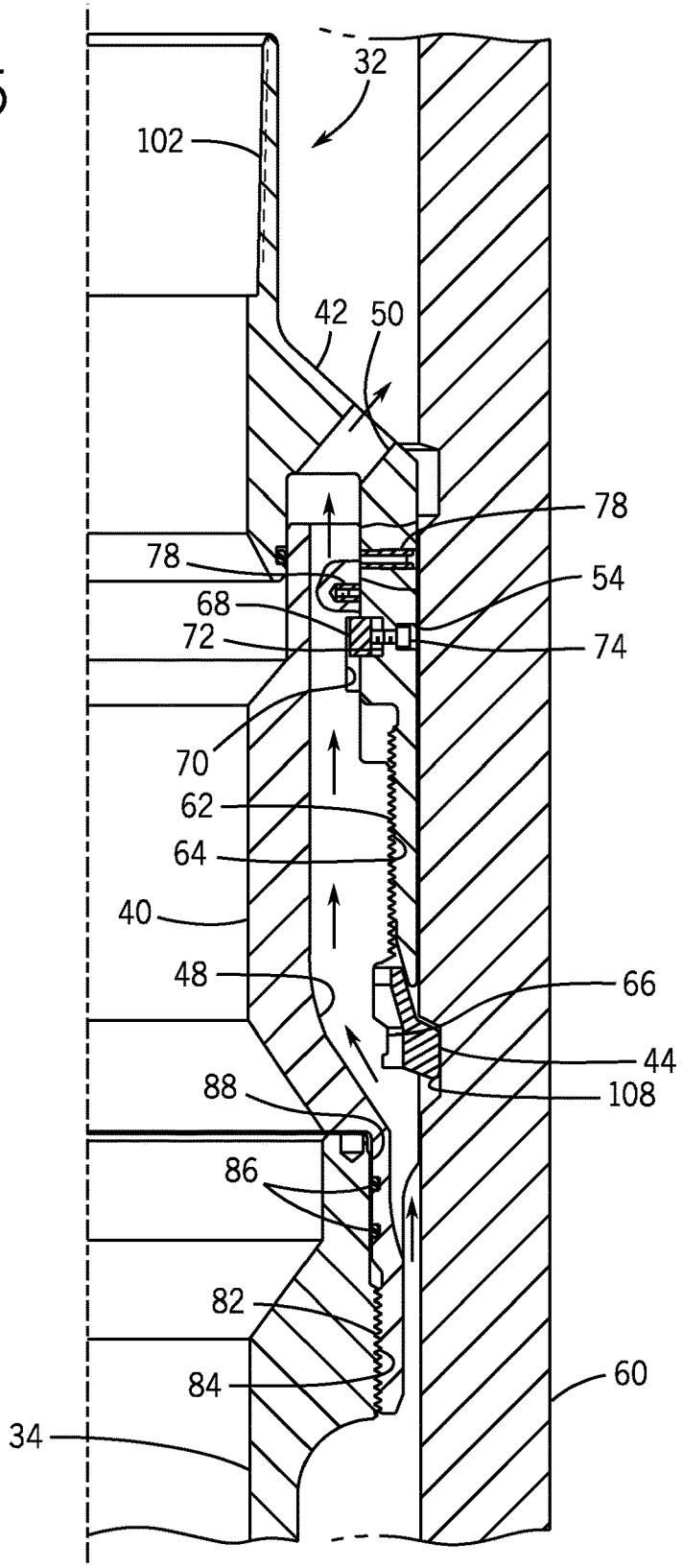
FIG. 5 is a section view of the tool of FIG. 2 and depicts the retaining ring in a locked position after rotating an outer body of the tool to release the retaining ring in accordance with one embodiment.
Figure 6:
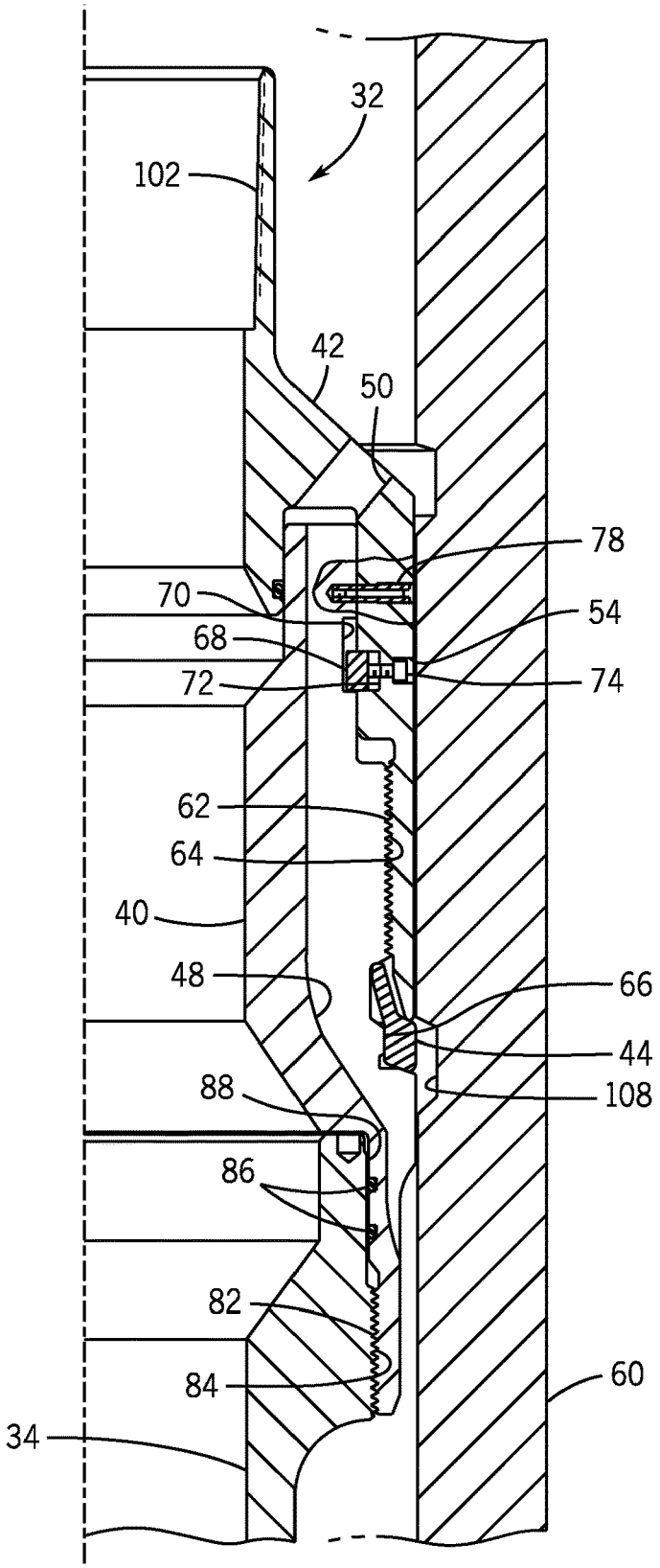
FIG. 6 is a section view of the tool of FIG. 2 after rotating the outer body of the tool to return the retaining ring to the unlocked position in accordance with one embodiment.

The lockdown tool 32 and the casing hanger 34 can be coupled to the landing string 36 with a threaded surface 102 of the outer body 42 and then run into the wellhead housing 60 to land the casing hanger 34 on its landing shoulder 24 (not shown in FIG. 3). When the casing hanger 34 is landed on its shoulder, the retaining ring 44 is aligned with a groove 108 in the wellhead housing 60. The retaining ring 44 can then be released by rotating the outer body 42 along the inner body 40 and allowing the retaining ring 44 to expand into and engage the groove 108, as shown in FIG. 5. In this position straddling both the groove 66 and the groove 108, the retaining ring 44 secures the lockdown tool 32 to the wellhead housing 60 and inhibits axial movement of the lockdown tool 32 and the casing hanger 34 within the wellhead housing 60. In at least some embodiments, the groove 108 is also used for installation of a seal assembly over the casing hanger 34 once cementing is complete and the tool 32 has been removed.

In addition to locking the casing hanger 34 in place, the tool 32 also helps ensure that the casing hanger 34 has been correctly landed. Particularly, the tool 32, the casing hanger 34, and the wellhead housing 60 are arranged such that the retaining ring 44 is aligned with the groove 108 only when the casing hanger is fully landed within the wellhead housing 60. If the casing hanger 34 is positioned off its landing shoulder, the retaining ring 44 would not align with the groove 108 and would not lock the tool 32 and the casing hanger 34 in place.

Cement can be pumped down through the lockdown tool 32, the casing hanger 34, and an attached casing string 28 to cement the casing string while the tool 32 locks the casing hanger 34 in place within the wellhead housing 60 and limits axial movement of the casing hanger 34 off its landing shoulder. Drilling mud returns (i.e., drilling mud displaced by the flowing cement) flow through the lockdown tool 32 via the slots 48 and ports 50, as generally represented by the arrows drawn in these passages in FIG. 5.

The lockdown tool 32 can then be disconnected from the casing hanger 34 (e.g., after the cement in the annular space outside the casing string is confirmed to be hard). To facilitate disconnection of the lockdown tool 32 from the casing hanger 34, in at least some instances the threaded surfaces 62 and 64 have threads provided in one direction and the threaded surfaces 82 and 84 have threads provided in an opposite direction. By way of example, the threaded surfaces 62 and 64 have right-handed threads and the threaded surfaces 82 and 84 have left-handed threads in at least one embodiment. In such an embodiment, once the casing hanger 34 is run into and landed within the wellhead housing 60 with the lockdown tool 32 (as shown in FIG. 3), the landing string 36 is rotated counter-clockwise to turn the outer body 42 counter-clockwise about the inner body 40. As the outer body 42 turns in this manner, it translates up the inner body 40 and allows the collapsed retaining ring 44 to expand into the groove 108 and lock the tool 32 and the casing hanger 34 within the wellhead housing 60 (as shown in FIG. 5). Further counter-clockwise rotation of the outer body 42 is limited by engagement of the stop ring 68 with the upper shoulder of the groove 70 of the inner body 40.

Figure 7:
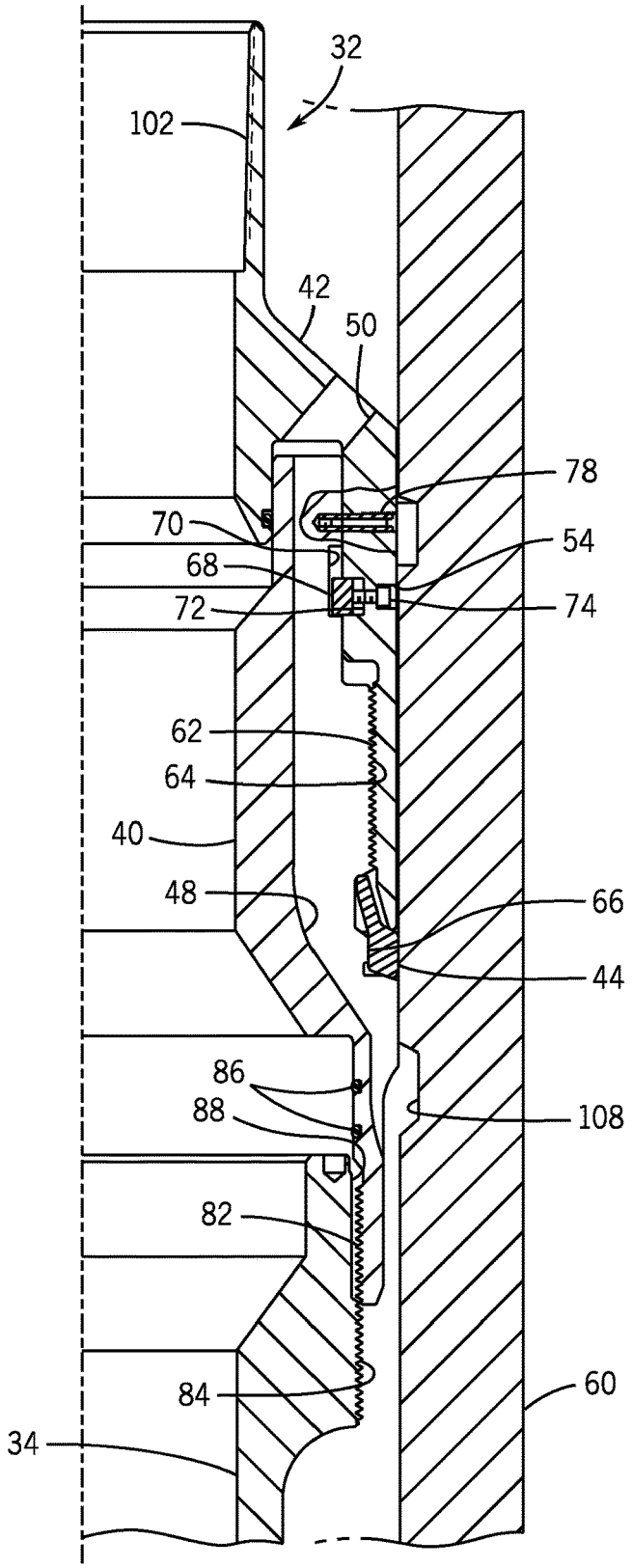
FIG. 7 is a section view of the tool of FIG. 2 after continuing to rotate the outer body of the tool following the return of the retaining ring to the unlocked position to disconnect an inner body of the tool from the casing hanger in accordance with one embodiment.

To unlock the tool 32 from the wellhead housing 60 (such as after cementing is completed and the cement has hardened), the landing string 36 can be rotated clockwise to thread the outer body 42 back down the inner body 40 and collapse the retaining ring 44 out of the groove 108. Axial movement of the outer body 42 down along the inner body 40 is again limited by engagement of the stop ring 68, this time with the lower shoulder of the groove 70. Continued clockwise rotation of the landing string 36 then causes both the outer body 42 and the inner body 40 to rotate together (after overcoming friction of the pins 92 on the seal neck 88) and backs the inner body 40 off of the casing hanger 34 until the tool 32 disconnects, as shown in FIG. 7. The tool 32 can then be removed from the wellhead housing 60 and a seal assembly (e.g., a packoff) can be installed over the casing hanger 34. In some embodiments, the groove 108 can also be used during installation of the seal assembly.

Figure 8:
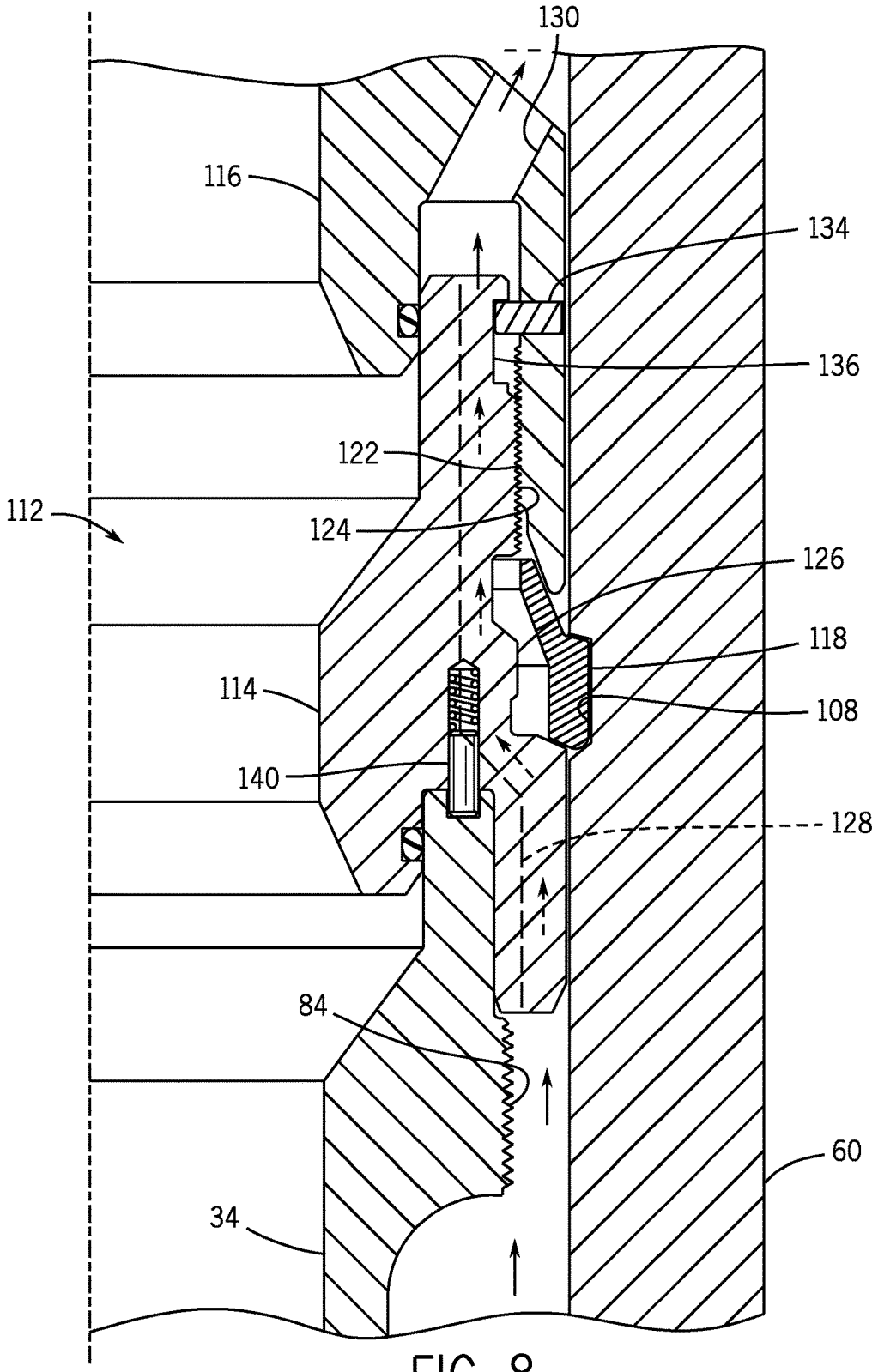
FIG. 8 is a section view of a tool for locking a casing hanger in place within the wellhead housing in accordance with one embodiment.

An additional lockdown tool 112 is depicted in FIG. 8 in accordance with another embodiment. The lockdown tool 112 includes an inner body 114 coupled to an outer body 116 via mating threaded surfaces 122 and 124. The lockdown tool 112 also includes a collapsible retaining ring 118 that functions similarly to the retaining ring 44 described above. That is, the outer body 116 can be rotated (e.g., by a landing string 36 coupled to the outer body 116) to translate along the inner body 114 and selectively release the retaining ring 118. The lockdown tool 112 and the casing hanger 34 can be locked in place by releasing the retaining ring 118 to extend out of groove 126 of the inner body 114 and into the groove 108, and then unlocked by collapsing the retaining ring 118, using the outer body 116. The inner body 114 and the outer body 116 include flow slots 128 and flow ports 130, which at least function similarly to slots 48 and ports 50 described above in that they allow drilling mud returns to flow through the tool 112. One or more stop pins 134 in the outer body 116 extend into a groove 136 and function similarly to the stop ring 68 to limit axial movement of the outer body 116 with respect to the inner body 114. Indeed, the stop pins 134 could be replaced by the stop ring 68 in other embodiments.

While the tool 112 depicted in FIG. 8 is configured as a lockdown and cementing tool, it is not configured as a running tool. Rather, the casing hanger 34 is installed in the wellhead housing 60 on a landing shoulder with a separate running tool. The tool 112 can then be run into the wellhead housing 60 to lock the installed casing hanger 34 in place during cementing. The inner body 114 includes one or more spring-loaded, anti-rotation pins 140 that prevent rotation of the inner body 114 with respect to the casing hanger 34. The springs allow the pins 140 to retract into the inner body 114 when the tool 112 is landed onto the casing hanger 34 with the pins 140 out of alignment with mating recesses in the casing hanger 34. The tool 112 can then be turned on the casing hanger 34. When the pins 140 are aligned with the mating recesses in the casing hanger 34, the biasing force of the springs pushes the pins 140 into the recesses. The mating engagement of the pins 140 with the recesses allows the inner body 114 to remain stationary while the outer body 116 is rotated to release and collapse the retaining ring 118.

Figure 9:
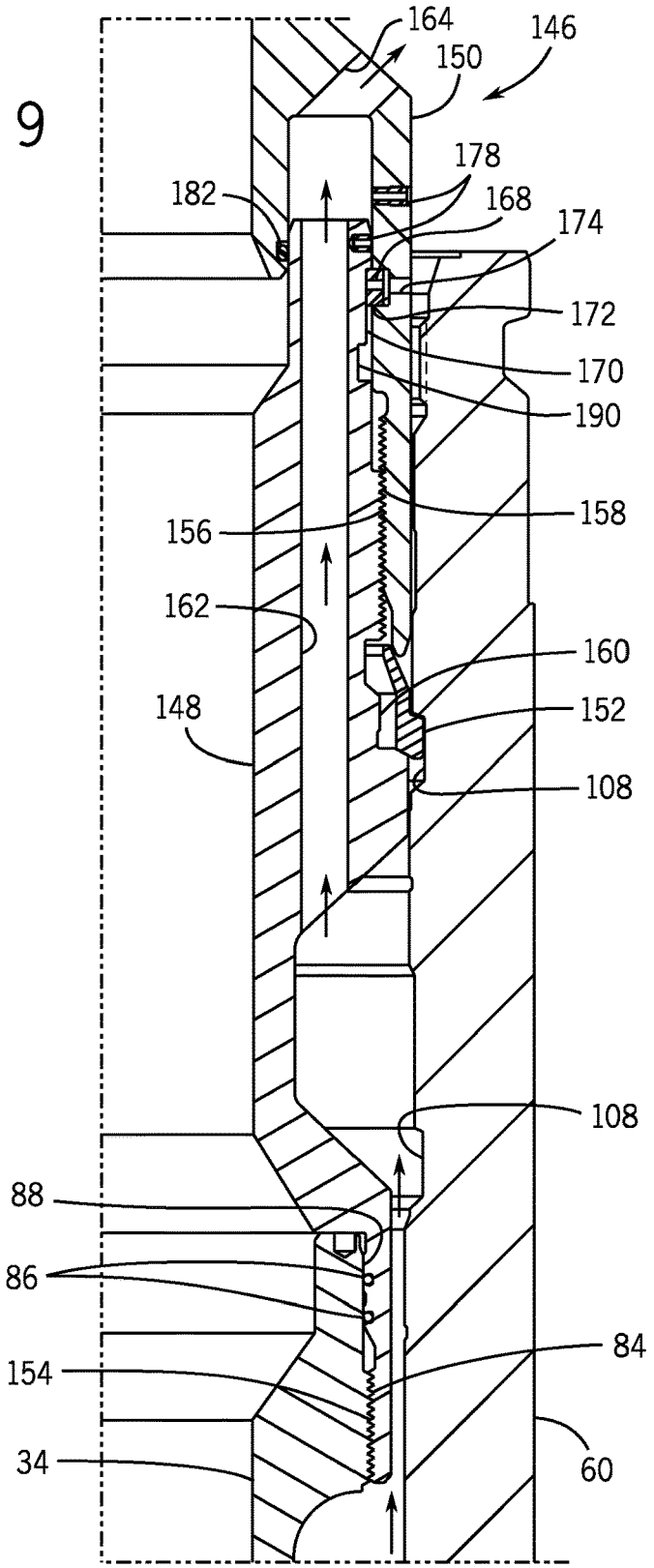
FIGS. 9-12 are section views of another tool for locking a casing hanger in place within the wellhead housing in accordance with certain embodiments.

Another lockdown tool 146 is depicted in FIG. 9 in accordance with one embodiment. The lockdown tool 146 includes an inner body 148, an outer body 150, and a collapsible retaining ring 152. The inner body 148 is coupled to a casing hanger 34 via mating threaded surfaces 84 and 154, and to the outer body 150 via mating threaded surfaces 156 and 158. The retaining ring 152 is similar or identical to the retaining rings 44 and 118, and can be selectively collapsed or released by rotating the outer body 150 about the inner body 148.

The wellhead housing 60 can have multiple grooves 108 capable of receiving a retaining ring 44, 118, or 152. In FIG. 5, the depicted portion of the wellhead housing 60 has two grooves and the retaining ring 44 of the lockdown tool 32 is received in the lower groove 108. In contrast, the retaining ring 152 is shown in FIG. 9 as extending from a groove 160 of the tool 146 and into an upper groove 108 (e.g., a tubing hanger locking groove) of the wellhead housing 60; this locks the tool 146 and the casing hanger 34 in place within the housing 60.

The lockdown tool 146 includes flow ports 162 through the inner body 148 and flow ports 164 through the outer body 150. Similar to the flow slots 48 and flow ports 50 described above, these flow ports 162 and 164 can be spaced circumferentially about the lockdown tool 146 and allow fluid (e.g., drilling mud returns) to flow through the tool 146, as generally represented by the arrows in FIG. 9. The flow ports 162 are positioned through the inner body 148 apart from the retaining ring 152, and this separation can reduce contamination of the groove 160 during cementing in some instances (e.g., in the event of over-cementing the casing).

The lockdown tool 146 also includes a stop ring 168 (e.g., a C-ring) that limits axial travel of the inner body 148 with respect to the outer body 150. In at least some embodiments, the stop ring 168 is inwardly biased and extends between a groove 170 of the inner body 148 and a groove 172 of the outer body 150. During assembly of the lockdown tool 146, screws can be inserted through holes 174 in the outer body 150 and threaded into tapped holes of the stop ring 168 to expand and hold the stop ring 168 in the groove 172 so that the stop ring 168 does not interfere with receipt of the inner body 148 in the outer body 150. Alignment of the screw holes 174 through the outer body 150 and the tapped holes in the stop ring 168 can be maintained with a locating peg. Once the grooves 170 and 172 are aligned, the assembly screws can be removed to allow the inward bias of the stop ring 168 to cause the stop ring 168 to contract and extend into the groove 170 of the inner body 148 from the groove 172.

The lockdown tool 146 can include various features to inhibit rotation of components relative to one another during assembly and running into a wellhead. For instance, like the shear screw 78 of the lockdown tool 32, a shear screw 178 can be installed through the outer body 150 and into the inner body 148 to prevent inadvertent rotation of the outer body 150 with respect to the inner body 148 during running of the casing hanger 34 and the lockdown tool 146 into the wellhead housing 60 (e.g., via a landing string 36 threaded to the upper end of the tool 146). Although not shown in FIG. 9, the lockdown tool 146 could also use holding pins, such as pins 92 described above with respect to FIG. 4, inserted through the inner body 148 into contact with the seal neck 88 of the casing hanger 34 to avoid unintentional rotation of the inner body 148 with respect to the casing hanger 34.

Figure 10:
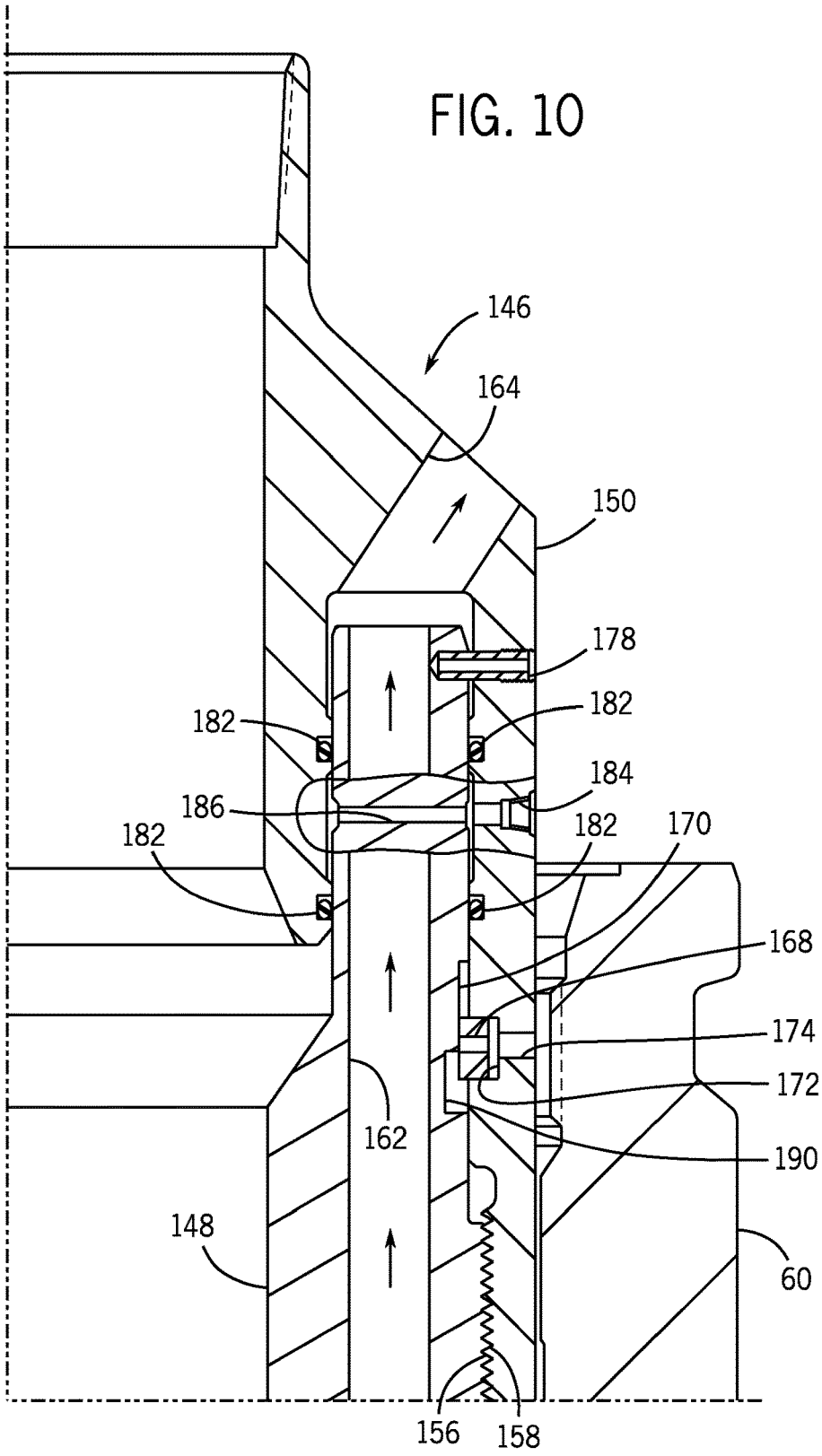

Seals 182 of the tool 146 inhibit leaking between the inner body 148 and the outer body 150. In one embodiment, the tool 146 includes a single seal 182 provided between an inner surface of the inner body 148 and an adjacent surface of the outer body 150, such as shown in FIG. 9. In another embodiment, such as that depicted in FIG. 10, the lockdown tool 146 includes a pressure-testable seal arrangement with a first pair of seals 182 in contact with the inner surface of the inner body 148 and an adjacent surface of the outer body 150, and a second pair of seals 182 at the exterior of the inner body 148 (i.e., in contact with the outer surface of the inner body 148 and an adjacent surface of the outer body 150). The lockdown tool 146 is shown in FIG. 10 as having a test port 184 in the outer body 150 and a fluid conduit 186 through the inner body 148. The fluid conduit 186 is provided between two flow ports 162 of the inner body 148 and connects the sealed regions between the inboard seals 182 and the outboard seals 182 so that both of these sealed regions and the conduit 186 are in fluid communication with the test port 184. This enables pressure testing of the seals 182 via the port 184 to verify proper sealing. The casing hanger 34 and the lockdown tool 146 can be assembled and pressure-tested at a remote facility before being shipped to a wellsite for installation in a wellhead housing 60.

When running the casing hanger 34 and the lockdown tool 146 into the wellhead housing 60, the stop ring 168 can be positioned in an intermediate position between the upper and lower ends of the groove 170, as shown in FIG. 10. After the casing hanger 34 is landed within the wellhead housing 60, the outer body 150 can be rotated with respect to the inner body 148 (e.g., via the landing string 36) to break the shear screw 178 and then release the retaining ring 152 and lock the tool 146 in place, as shown in FIG. 9. In at least some embodiments, the surfaces 156 and 158 (along with the surfaces 84 and 154) are threaded with left-handed threads and the outer body 150 is rotated clockwise to cause the outer body 150 to travel upward along the inner body 148. When rotating the outer body 150 to release the retaining ring 152, the stop ring 168 travels with the outer body 150 toward the upper end of the groove 170. With the lockdown tool 146 secured in the bore of the wellhead housing 60, the well can be cemented as described above.

Figure 11:
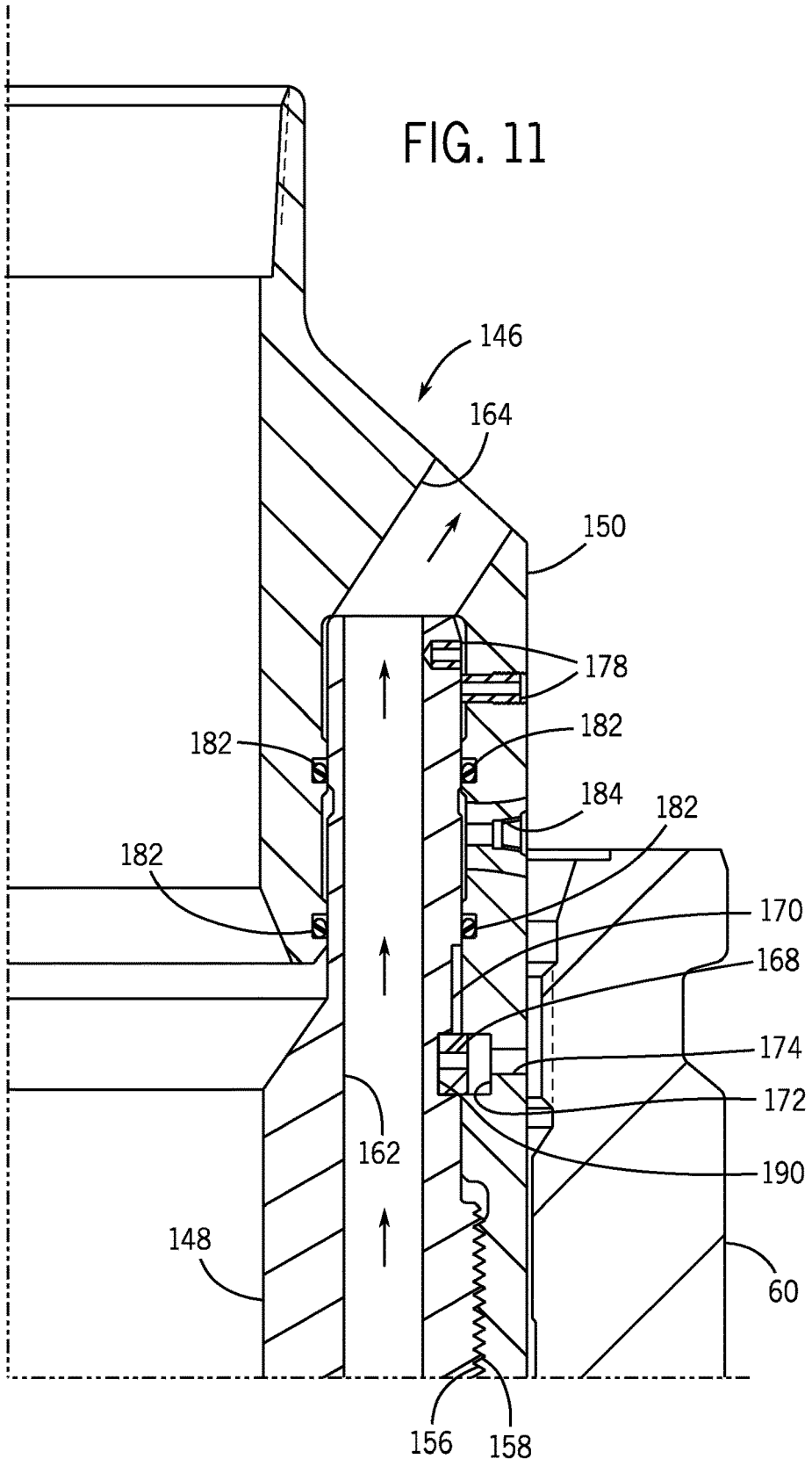

To remove the lockdown tool 146 from the wellhead housing 60 (e.g., once cement in the well has sufficiently hardened), the outer body 150 is rotated (counter-clockwise in the case of left-handed threaded surfaces 156 and 158) to move the outer body 150 down along the inner body 148 and retract the retaining ring 152 from the groove 108. The outer body 150 can then continue to be rotated down the inner body 148 until the stop ring 168 retracts inwardly into a recessed portion 190 at the lower end of the groove 170, as shown in FIG. 11. With the stop ring 168 received in the recessed portion 190, which can also be referred to as an additional groove 190, the outer body 150 can then be rotated in the opposite direction (e.g., clockwise in the case of left-handed threaded surfaces 156 and 158). The stop ring 168 in the recessed portion 190 causes the inner body 148 to rotate synchronously with the outer body 150, allowing the rotation to unthread the inner body 148 from the casing hanger 34. The disconnected lockdown tool 146 can then be pulled out of the wellhead housing 60.

Figure 12:
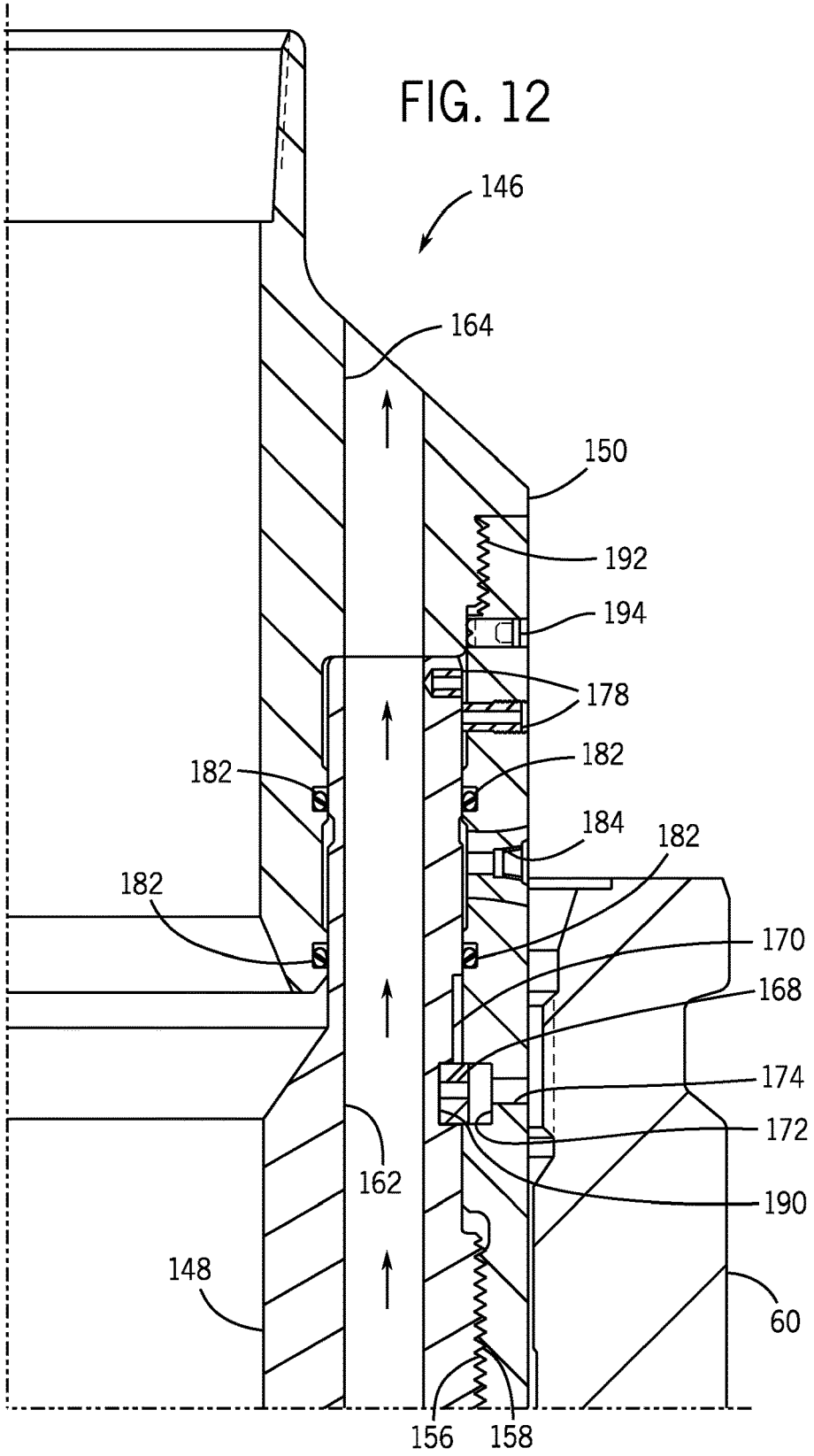

Finally, although the various lockdown tools described above can include one-piece outer bodies, in at least some embodiments a lockdown tool can include an outer body assembled from multiple components. For example, as shown in FIG. 12, the outer body 150 of the lockdown tool 146 is formed from two components coupled together via a threaded interface 192. Set screws 194 can be used to prevent inadvertent unthreading of the two components. In some instances, a multi-piece outer body can be used for ease of manufacturing.

While the aspects of the present disclosure may be susceptible to various modifications and alternative forms, specific embodiments have been shown by way of example in the drawings and have been described in detail herein. But it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. A system comprising:

a lockdown tool for inhibiting movement of a casing hanger within a wellhead housing, the lockdown tool including:

an inner body;

an outer body coupled to the inner body; and a locking mechanism carried by the inner body, wherein the locking mechanism can be selectively engaged by moving the outer body with respect to the inner body to secure the lockdown tool to the wellhead housing;

wherein the inner body and the outer body each include a central bore, the inner body includes at least one flow passage that is independent of the central bore of the inner body, the outer body includes at least one flow passage that is independent of the central bore of the outer body, and the flow passages of the inner and outer bodies together enable fluid flow through the lockdown tool apart from the central bores of the inner and outer bodies.

2. The system of claim 1, wherein the locking mechanism includes a retaining ring.

3. The system of claim 2, wherein the inner body and the outer body are threaded to one another and the locking mechanism can be selectively engaged by rotating the outer body with respect to the inner body.

4. The system of claim 3, comprising the casing hanger, wherein the inner body and the casing hanger are threaded to one another.

5. The system of claim 4, wherein the inner body and the outer body are threaded to one another via surfaces that are threaded in one direction and the inner body and the casing hanger are threaded to one another via surfaces that are threaded in an opposite direction.

6. The system of claim 4, wherein the inner body has a plurality of holes aligned with a neck of the casing hanger to enable pins within the plurality of holes to engage the neck of the casing hanger to resist rotation of the inner body with respect to the casing hanger.

7. The system of claim 1, wherein the lockdown tool includes a stop ring that limits movement of the outer body with respect to the inner body.

8. The system of claim 1, comprising:

a first pair of seals in sealing contact with the outer body and an inner surface of the inner body; and a second pair of seals in sealing contact with the outer body and an outer surface of the inner body;

wherein the inner body includes a conduit that places a first region between the outer body, the inner surface of the inner body, and the first pair of seals in fluid communication with a second region between the outer body, the outer surface of the inner body, and the second pair of seals, and wherein the outer body includes a test port in fluid communication with the conduit.

9. A method comprising:

running a casing hanger lockdown tool into a bore of a wellhead housing, the casing hanger lockdown tool including:

an inner body;

an outer body coupled to the inner body; and a locking mechanism carried by the inner body, wherein the locking mechanism can be selectively engaged by moving the outer body with respect to the inner body to secure the lockdown tool to the wellhead housing;

wherein the inner body and the outer body each include a central bore, the inner body includes at least one flow passage that is independent of the central bore of the inner body, the outer body includes at least one flow passage that is independent of the central bore of the outer body, and the flow passages of the inner and outer bodies together enable fluid flow through the casing hanger lockdown tool apart from the central bores of the inner and outer bodies; and locking the casing hanger lockdown tool to the wellhead housing to inhibit axial movement of a casing hanger inside the bore of the wellhead housing below the casing hanger lockdown tool.

10. The method of claim 9, comprising pumping cement into a well through the casing hanger lockdown tool to cement a casing string coupled to the casing hanger while the casing hanger lockdown tool is locked to the wellhead housing.

11. The method of claim 9, wherein locking the casing hanger lockdown tool to the wellhead housing includes extending the locking mechanism of the casing hanger lockdown tool into engagement with the wellhead housing.

12. The method of claim 11, wherein extending the locking mechanism of the casing hanger lockdown tool into engagement with the wellhead housing includes extending a retaining ring of the casing hanger lockdown tool into engagement with the wellhead housing, and wherein locking the casing hanger lockdown tool to the wellhead housing includes rotating the outer body of the casing hanger lockdown tool in a first direction with respect to the inner body of the casing hanger lockdown tool to release the retaining ring and allow the retaining ring to expand into a groove of the wellhead housing.

13. The method of claim 12, comprising:

unlocking the casing hanger lockdown tool from the wellhead housing by rotating the outer body of the casing hanger lockdown tool in a second direction, opposite the first direction, with respect to the inner body of the casing hanger lockdown tool to collapse the retaining ring out of the groove of the wellhead housing;

continuing to rotate the outer body of the casing hanger lockdown tool in the second direction to unthread the inner body of the casing hanger lockdown tool from the casing hanger; and removing the casing hanger lockdown tool from the wellhead housing.

14. The method of claim 12, comprising:

unlocking the casing hanger lockdown tool from the wellhead housing by rotating the outer body of the casing hanger lockdown tool in a second direction, opposite the first direction, with respect to the inner body of the casing hanger lockdown tool to collapse the retaining ring out of the groove of the wellhead housing;

continuing to rotate the outer body of the casing hanger lockdown tool in the second direction to cause an inwardly biased stop ring of the casing hanger lockdown tool to contract into a groove in the inner body of the casing hanger lockdown tool;

once the stop ring contracts into the groove in the inner body, rotating the outer body of the casing hanger lockdown tool in the first direction to unthread the inner body of the casing hanger lockdown tool from the casing hanger; and removing the casing hanger lockdown tool from the wellhead housing.

15. A system comprising:

a lockdown tool for inhibiting movement of a casing hanger within a wellhead housing, the lockdown tool including:

an inner body;

an outer body coupled to the inner body;

a locking mechanism carried by the inner body, wherein the locking mechanism can be selectively engaged by moving the outer body with respect to the inner body to secure the lockdown tool to the wellhead housing;

a first pair of seals in sealing contact with the outer body and an inner surface of the inner body; and a second pair of seals in sealing contact with the outer body and an outer surface of the inner body;

wherein the inner body includes a conduit that places a first region between the outer body, the inner surface of the inner body, and the first pair of seals in fluid communication with a second region between the outer body, the outer surface of the inner body, and the second pair of seals, and wherein the outer body includes a test port in fluid communication with the conduit.

16. The system of claim 15, wherein the locking mechanism includes a retaining ring.

17. The system of claim 16, wherein the inner body and the outer body are threaded to one another and the locking mechanism can be selectively engaged by rotating the outer body with respect to the inner body.

18. The system of claim 17, comprising the casing hanger, wherein the inner body and the casing hanger are threaded to one another.

19. The system of claim 18, wherein the inner body and the outer body are threaded to one another via surfaces that are threaded in one direction and the inner body and the casing hanger are threaded to one another via surfaces that are threaded in an opposite direction.

20. The system of claim 18, wherein the inner body has a plurality of holes aligned with a neck of the casing hanger to enable pins within the plurality of holes to engage the neck of the casing hanger to resist rotation of the inner body with respect to the casing hanger.

* * * * *